US010071302B2

(12) United States Patent
Sala

(10) Patent No.: US 10,071,302 B2
(45) Date of Patent: Sep. 11, 2018

(54) FOLDING LONGBOARD BASED ON AN INDIVISIBLE FLEXIBLE ELEMENT

(71) Applicant: Augusto Sala, Rolo (IT)

(72) Inventor: Augusto Sala, Rolo (IT)

(73) Assignee: Augusto Sala (IT)

( * ) Notice: Subject to any disclaimer, the term of this patent is extended or adjusted under 35 U.S.C. 154(b) by 267 days.

(21) Appl. No.: 14/872,245

(22) Filed: Oct. 1, 2015

(65) Prior Publication Data

US 2017/0095725 A1 Apr. 6, 2017

(51) Int. Cl.
*A63C 17/01* (2006.01)
*A63C 17/26* (2006.01)

(52) U.S. Cl.
CPC ..... *A63C 17/015* (2013.01); *A63C 17/26* (2013.01); *A63C 2203/10* (2013.01)

(58) Field of Classification Search
CPC ..... A63C 17/02; A63C 17/04; A63C 17/045; A63C 17/06; A63C 2203/10; B62K 15/006
See application file for complete search history.

(56) References Cited

U.S. PATENT DOCUMENTS 781,243 A * 1/1905 Thompson ..... B62B 3/02 280/35
1,302,301 A * 4/1919 Broome ..... B25H 5/00 280/32.6
3,689,093 A * 9/1972 Meland ..... A63C 5/02 280/603
4,125,273 A * 11/1978 Rothmayer ..... A63C 5/02 16/264
4,458,912 A * 7/1984 Bertonneau ..... A63C 5/02 280/603
4,632,418 A * 12/1986 Brue Moya ..... A63C 5/02 280/603
5,505,474 A * 4/1996 Yeh ..... A63C 5/02 280/87.042
5,618,051 A * 4/1997 Kobylenski ..... A63C 5/02 280/14.21
5,865,446 A * 2/1999 Kobylenski ..... A63C 5/02 280/14.23
6,131,931 A * 10/2000 Globerson ..... A63C 17/01 280/20
6,616,170 B1 * 9/2003 Quarti ..... A63C 5/02 280/603
6,631,913 B2 * 10/2003 Godfrey ..... A63C 17/01 280/87.041
7,150,461 B2 * 12/2006 Schnuckle ..... A63C 11/023 280/87.05
7,976,034 B1 * 7/2011 Hong ..... A63C 17/01 280/87.042
8,459,670 B1 * 6/2013 Tizzone ..... A63C 17/015 280/87.042

(Continued)

*Primary Examiner* — Emma K Frick

(57) ABSTRACT

A foldable longboard composed of a deck split in multiple sections connected on their lower surface with a folding assembly having an indivisible flexible element capable of bending near the interface between the different sections of the deck, allowing therefore said sections to be rotated in one direction to a folded position where the bottom surfaces of each section face each other, while inhibiting said sections to rotate in the other direction, against each other's top surface, when the longboard is in its elongated configuration.

7 Claims, 11 Drawing Sheets

(56) References Cited

U.S. PATENT DOCUMENTS

| | | | | |
|---|---|---|---|---|
| 8,827,286 | B2 * | 9/2014 | Woncik | A63C 17/0006 280/87.042 |
| 8,910,959 | B2 * | 12/2014 | Alva | A63C 17/015 280/87.05 |
| 9,095,766 | B1 * | 8/2015 | Christie | A63C 17/01 |
| 9,504,901 | B1 * | 11/2016 | Lu | A63C 17/017 |
| 9,811,119 | B2 * | 11/2017 | Seo | G06F 1/1652 |
| 2007/0117600 | A1 * | 5/2007 | Robertson, Jr. | H04M 1/0216 455/575.3 |
| 2008/0174089 | A1 * | 7/2008 | Ekberg | A63C 5/02 280/603 |
| 2012/0307423 | A1 * | 12/2012 | Bohn | G06F 1/1641 361/679.01 |
| 2015/0360756 | A1 * | 12/2015 | Sciarra | B63B 35/7916 441/74 |
| 2016/0114242 | A1 * | 4/2016 | Riley | A63C 17/012 180/233 |
| 2016/0339326 | A1 * | 11/2016 | Postaire | A63C 5/02 |
| 2016/0367884 | A1 * | 12/2016 | Chiu | A63C 17/12 |
| 2017/0216709 | A1 * | 8/2017 | Smith | A63C 5/02 |

* cited by examiner

FOLDING LONGBOARD BASED ON AN INDIVISIBLE FLEXIBLE ELEMENT

1. CROSS-REFERENCE TO RELATED APPLICATIONS

| U.S. patent documents | | |
|---|---|---|
| 781,243 A | January 1905 | Sedgefield Thompson |
| 1,302,301 A | April 1919 | William J Broome |
| 5,505,474 | April 1996 | Hsiu-Ying Yeh |
| 6,131,931 | October 2000 | Justin D., Marlan B. and Terry L. Globerson |
| 6,631,913 B2 | October 2003 | Alonzo Edward Godfrey |
| 7,150,461 B2 | December 2006 | Gary Schnuckle, David A. Powell |
| 7,976,034 B1 | July 2011 | Tomas K. Hong, Eunha Hong |
| 8,459,670 B1 | June 2013 | Vincenzo Tizzone |

2. BACKGROUND OF THE INVENTION

Skateboards and longboards are well known recreational devices used by people to slide on wheels over a smooth surface such as concrete, asphalt or similar. Skateboards are typically 70 cm to 87 cm long, lightweight and targeted to people willing to perform tricks and acrobatic manoeuvres such as jumps and spins. Longboards, instead, are focused on people willing to use the board for recreational cruising, commuting or for high speed downhill rides. For this reason they tend to be longer (80 cm to 150 cm) and wider, with bigger wheels (60 mm to 100 mm in diameter) and improved stability at high speed. While this is good for the main purposes of a longboard, it raises problems for commuters or generally speaking for every user at the moment when said longboard is to be carried around before or after the main activity. For this reason a foldable longboard is needed in order to give access to the stability and safety of a proper sized longboard to people in need to transport the device in backpacks or store it in small closets.

The present invention proposes a longboard that can be folded for easy storage and transportation when not in use.

A preliminary review of prior art and patents was conducted by the applicant in order to ensure the novelty of this invention. The review highlighted similar solutions but none of them is based on the flexibility of a specific part to be bent when the device is in folded configuration. The patented solutions found are all based on multiple moving parts like metal hinges or complex mechanical systems with levers, springs or pivots.

Prior art for foldable longboards also exist with designs based on metal hinges. While this is a possible approach, it doesn't offer good stability over time because typically, and in particular when high forces and vibrations are applied, hinges get torn quickly. In addition to this, the classic clean profile of a single piece longboard is altered with these bulky metal structures placed along the board line. Furthermore the metal parts involved in using hinges, such as nuts, bolts and the hinges themselves, might get loose or rusty and the interface between said hinges and the deck constitute a single point of failure on said deck.

In U.S. Pat. No. 8,459,670 a longboard with a hinged joint is claimed that is probably the closest solution to the one claimed in this patent application. The deck is split in two parts with two hinges mounted on the lower surfaces of both parts, through additional interfacing blocks. Said hinges are in charge of keeping both parts of the deck together while allowing it to switch between its elongated configuration and its folded configuration.

In U.S. Pat. No. 7,976,034 a skateboard divided in 3 parts connected through articulated pivot means that include two pivot pins each is claimed. Said skateboard folds in the opposite direction compared to the longboard claimed by this patent application and, therefore, a complex system for locking said skateboard in its elongated configuration is required as the weight of the user acting on the central part of the skateboard during normal use will tend to set said skateboard in its folded configuration.

In U.S. Pat. No. 6,131,931 a different folding skateboard is proposed again divided in 3 sections but again using hinges for interconnect said sections. The hinges are connected on the lower surfaces of the deck sections and the skateboard folds in a similar way to the longboard presented in this patent application.

In U.S. Pat. No. 5,505,474 a different approach is proposed by folding the board in three parts along the vertical axis. Metal pivots are used to keep the parts together and allowing the movement needed for entering the folded configuration. The object described is very different from a conventional skateboard as it is composed of two separated foot plates instead of a single deck split in more parts.

At the time of writing, the applicant is not aware of any prior art or patented solution that uses one or more indivisible element, each of which being connected to the multiple parts of the deck where the capability of bending of said indivisible element is exploited to fold and unfold the longboard.

3. SUMMARY OF THE INVENTION

The present invention proposes a folding longboard composed of a deck split in two or more parts along its length. Said parts are connected together with an element that is able to bend without stretching significantly when in its elongated position. Said element will be typically attached to the respective lower surfaces of each part of the deck and will be bent in order to set the deck into its folded configuration while avoiding the deck to fold in the opposite direction when the longboard is in its elongated configuration. In details, the element will be straight when the board is in its elongated configuration with the deck parts touching each other at their interface margin and trying to pass beyond such position by rotating the deck parts further, will involve tension on said element.

This construction allows for such folding longboards to look totally similar to regular ones when in their elongated configuration because the profile of the board can be as clean as if there was no splitting on the board at all, contrarily to having a strong, and typically big, hinge connecting the parts together.

Moreover, said element might spread the forces involved in keeping the deck in its elongated position along the whole board and, contrarily to the existing solutions based on hinges, there won't be a small area of the deck where all the stresses are focused such as nearby the holes where the hinges are fixed to the deck with screws or nuts and bolts. Another advantage of this solution is the potential absence of metal parts in the folding mechanism such as nuts, bolts, screws and the hinges themselves that might become loose, rusty or noisy when vibrating.

4. DESCRIPTION OF THE DRAWINGS

The following drawings are submitted with this utility patent application.

5. DETAILED DESCRIPTION OF THE INVENTION

Figure 1:
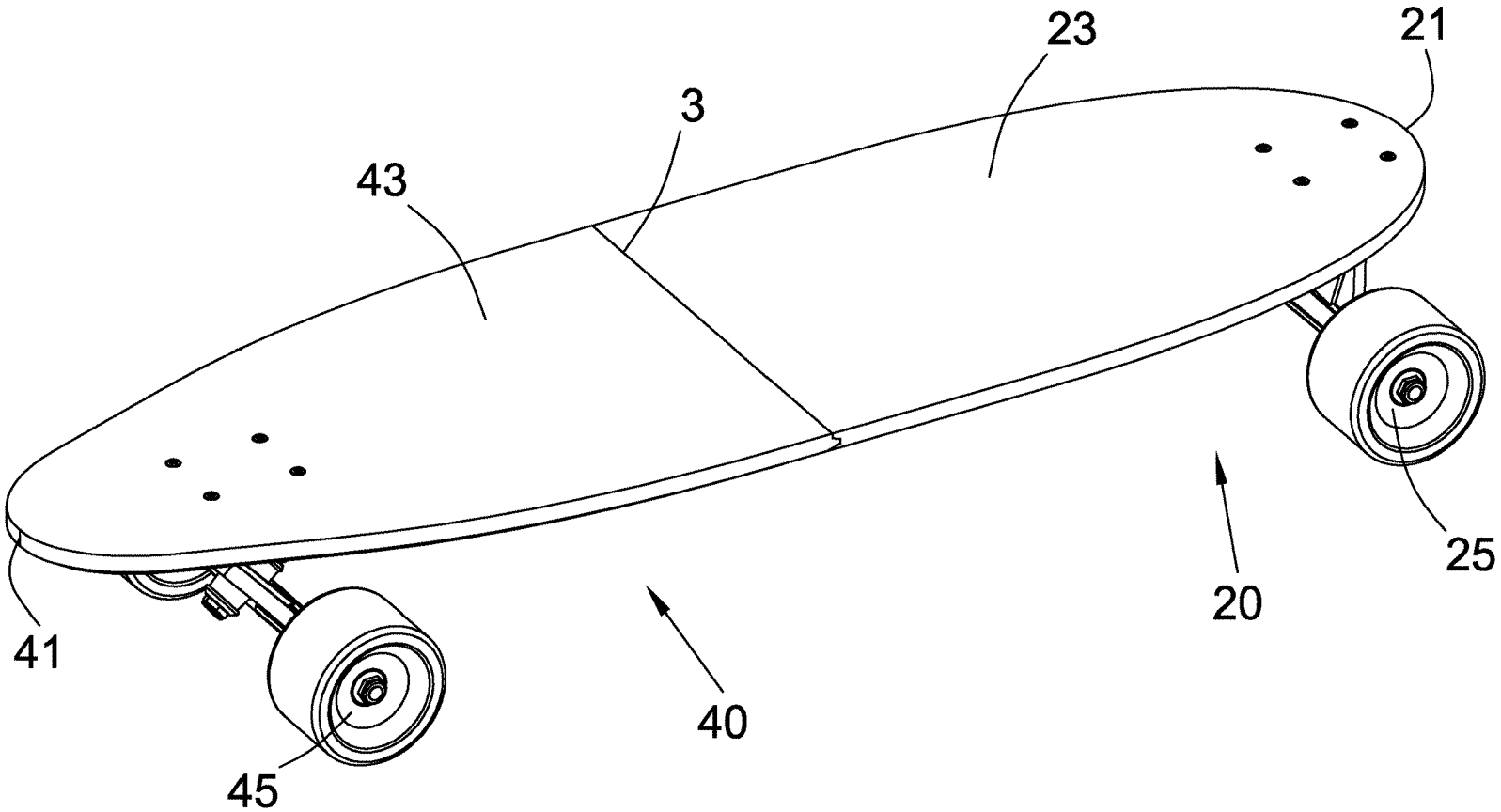
FIG. 1 is a top perspective view of the longboard in its elongated configuration where the flexible element is implemented with layers of industrial fibers.
Figure 2:
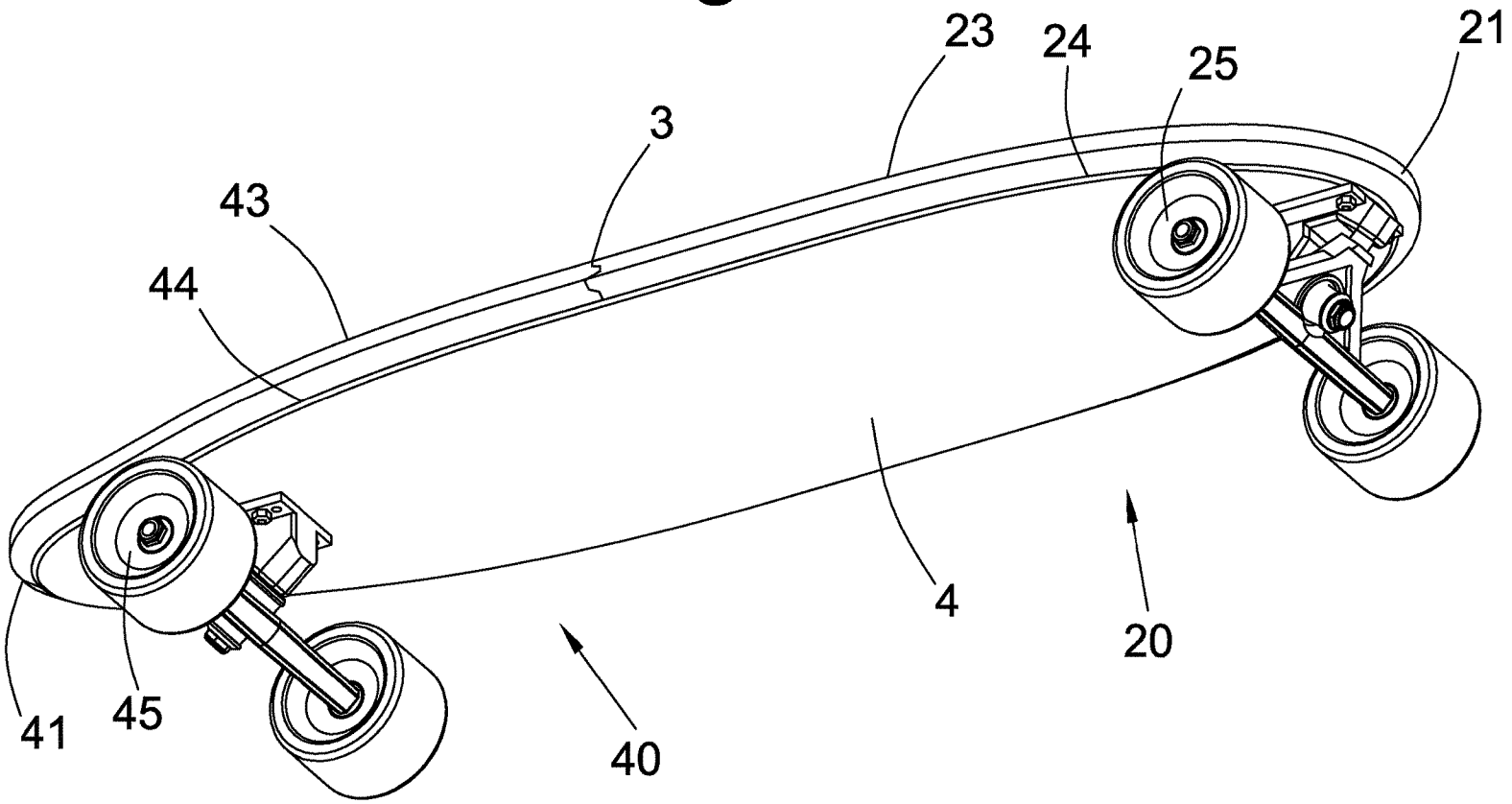
FIG. 2 is a bottom perspective view of the longboard in its elongated configuration where the flexible element is implemented with layers of industrial fibers.
Figure 3:
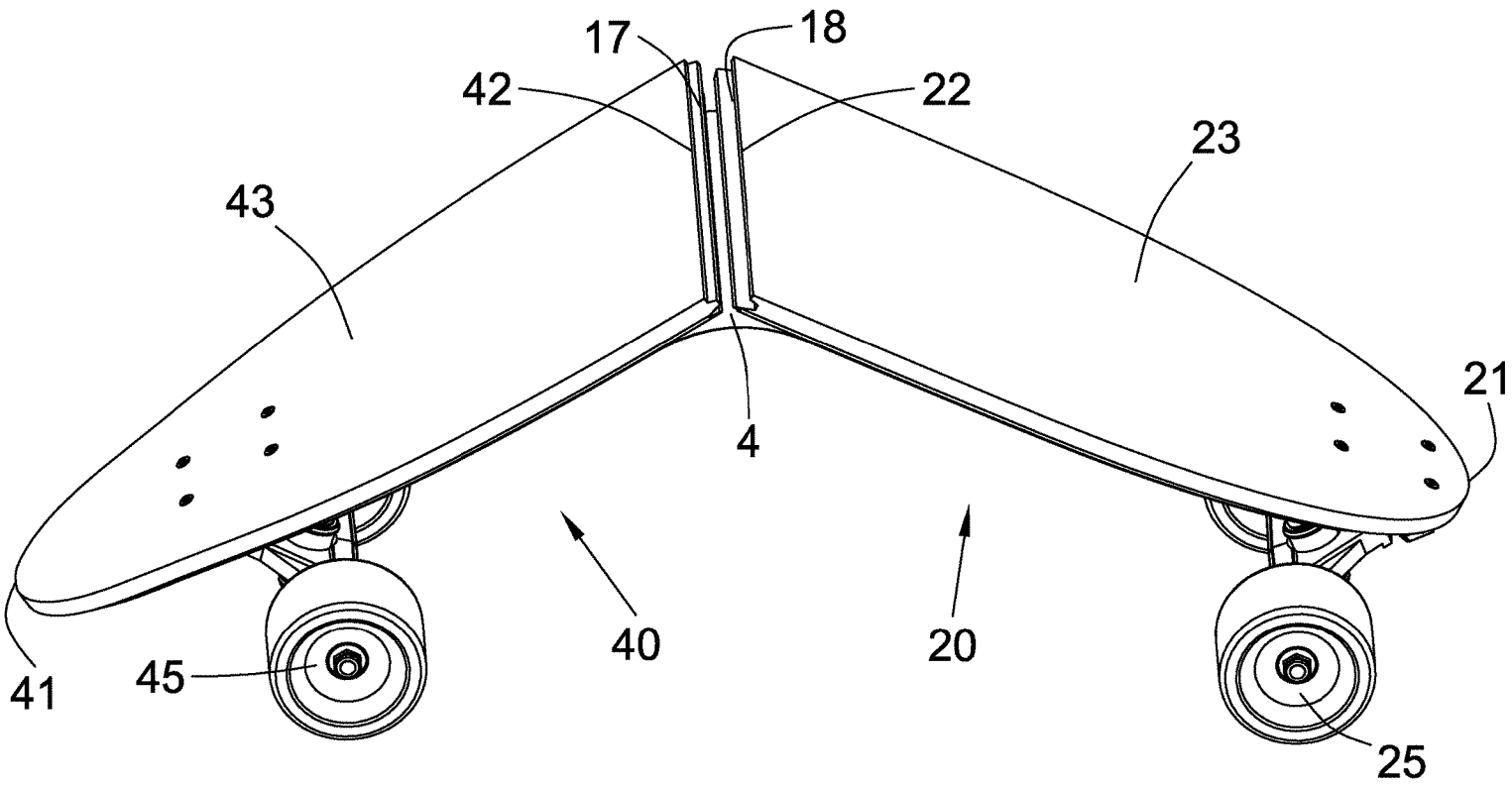
FIG. 3 is a top perspective view of the longboard set halfway between its elongated configuration and its folded configuration where the flexible element is implemented with layers of industrial fibers.
Figure 4:
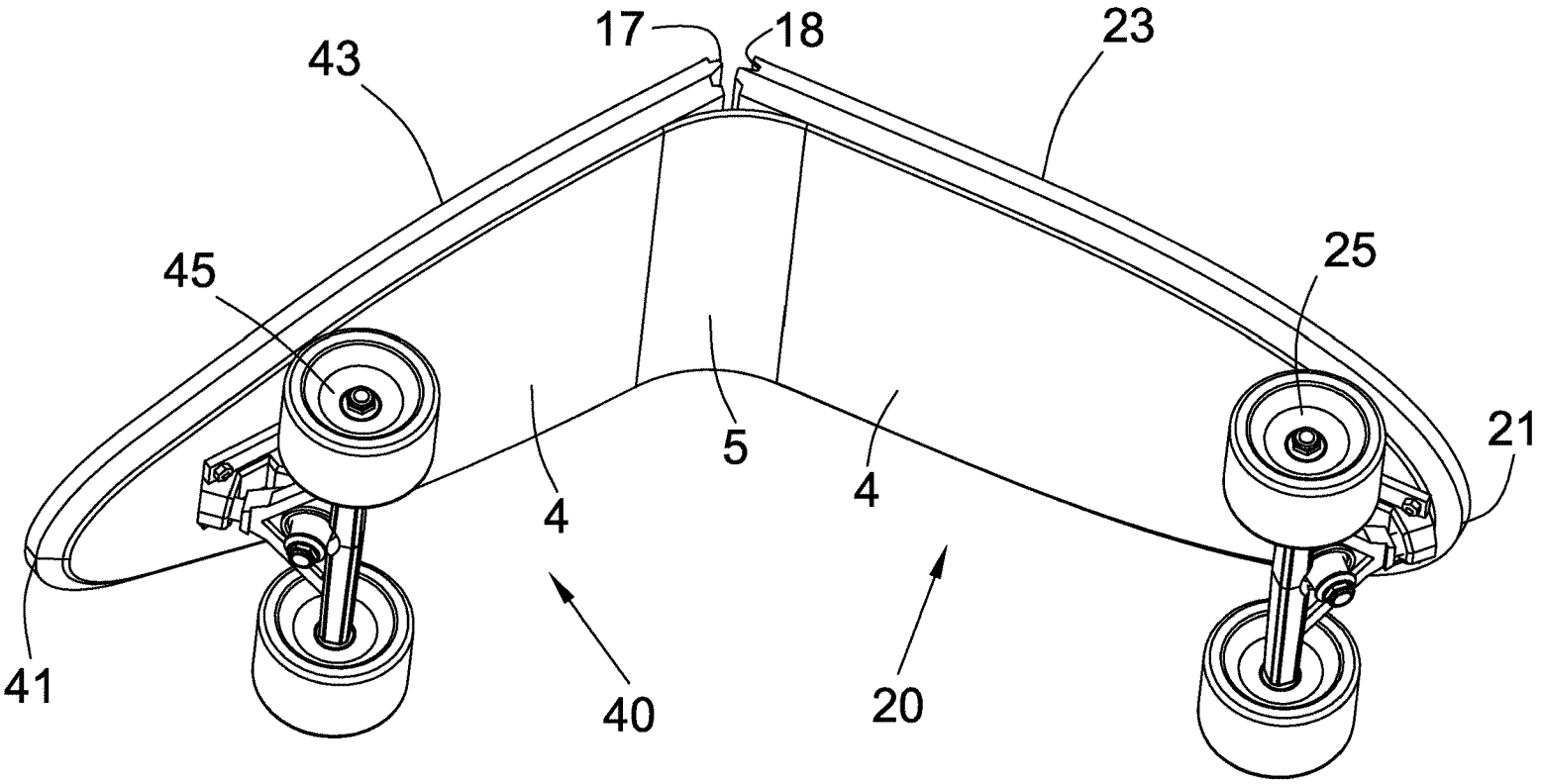
FIG. 4 is a bottom perspective view of the longboard set halfway between its elongated configuration and its folded configuration where the flexible element is implemented with layers of industrial fibers.
Figure 5:
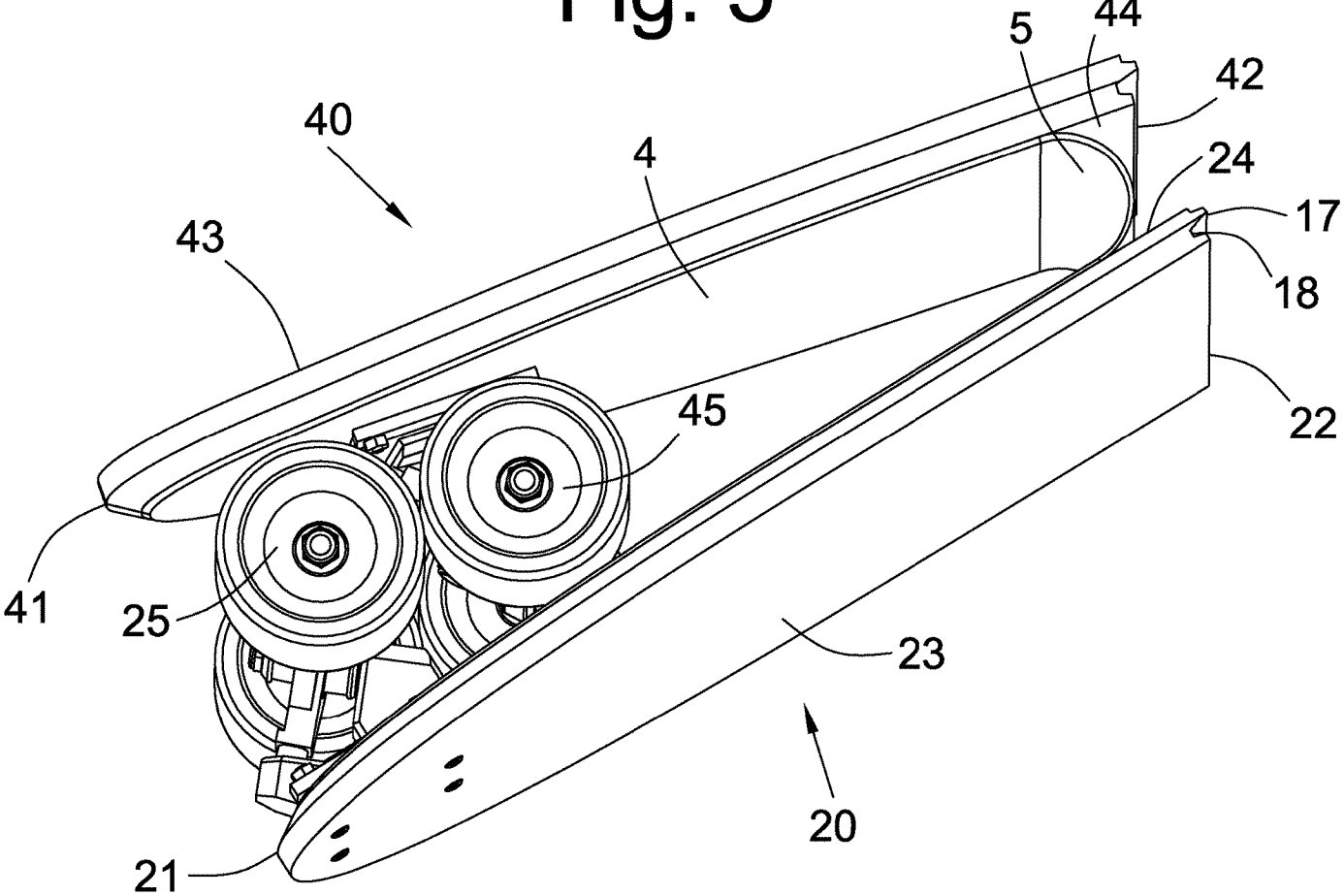
FIG. 5 is a bottom perspective view of the longboard in its folded configuration where the flexible element is implemented with layers of industrial fibers.

To better understand how this invention operates while expressing with clear and concise words, some possible embodiments are presented. The description of these embodiments should not be taken in a limiting sense; they have the mere purpose of illustrating the general principles of the invention, since the scope of the invention is best defined by the appended claims.

Parts and sections will be mentioned with reference numbers quoting portions of one or more of the drawings attached. While it is assured that there is at least one occurrence of the reference number in at least one of the drawings in the mentioned group, some of the cited drawings might omit showing a specific referenced part whenever said part is not clearly visible or whenever indicating it in said drawing might introduce confusion or ambiguity.

Generically all the embodiments described for this invention, as illustrated in FIGS. 1-11, provide a folding longboard comprising a deck split in two sections, a front section 20 and a rear section 40. Said front section 20 having a front end 21, a rear joint margin 22, and upper surface 23, a lower surface 24 and featuring a wheel assembly 25 near said front end 21. Said rear section 40 having a rear end 41, a front joint margin 42, an upper surface 43, a lower surface 44 and featuring a wheel assembly 45 near said rear end 41. At least one flexible element 4 is attached to said lower surfaces 24 and 44 of both sections 20 and 40.

For the sake of simplicity, the description might refer to a longboard with one flexible element only. For longboards using two or more flexible elements, the same considerations should be done for each flexible element as said flexible elements are all attached to both sections, mounted in the same direction and perform similarly.

Said folding longboard will have two possible configurations: a folded configuration where said flexible element 4 is bent and said lower surfaces 24 and 44 of said deck sections 20 and 40 face each other and an elongated configuration where said flexible element 4 is straight, said joint margins 22 and 42 of the deck sections 20 and 40 are touching at the interface between sections 3 and said upper surfaces 23 and 43 of both sections 20 and 40 are mutually substantially coplanar and form a contiguous longboard deck. Entering the elongated configuration from the folded configuration is done by rotating the deck sections 20 and 40 in the direction needed for straightening out the flexible element 4. Such direction will be referred in this patent application as the unfolding direction. When said flexible element 4 is straight, and the joint margins 22 and 42 of the deck sections 20 and 40 are touching, no further rotation of the deck sections along the same direction is possible unless the flexible element 4 stretches along its length or the deck sections 20 and 40 get compressed near the interface 3 between them. For this reason the flexible element 4 must be able to sustain a high tensile load without significant elongation. Likewise, when a rider stands on top of the elongated longboard with both its feet between the two wheel assembly 25 and 45, as it is usually done in regular longboards, its weight forces the deck parts 20 and 40 to further rotate in the unfolding direction where the interface 3 between said sections 20 and 40 tend to get closer to the ground. Such movement translates to a tensile load on the flexible element 4 along its length and a compressive load on the deck sections 20 and 40 near the interface 3 between said sections 20 and 40 along their length that is the direction coming from the front end of the deck 21 to the rear end of the deck 41. Being the deck able to sustain such compressive load and being the flexible element 4 engineered in order to stand such tensile load without relevant elongation, the deck sections 20 and 40 will maintain their desired position keeping the longboard in its elongated configuration and preventing the interface 3 between said sections 20 and 40 from getting close to the ground. When the center of mass of the rider doesn't fall near the interface 3 between said sections 20 and 40, said rear joint margin 22 might tend to drift vertically against said front joint margin 42 as there is nothing preventing such movement. To avoid this, one or more tongue and groove joints composed of slots 18 and ridges 17, can be implemented on said rear and front joint margins 22 and 42 of said deck sections 20 and 40.

One of the possible embodiments of the invention, as illustrated in FIGS. 1-9, implements the at least one flexible element 4 delineated in the claims with a panel composed of one or more layers of glass fibers or synthetic fibers chosen among carbon fibers, aramid fibers or mixes of these. Said panel is bonded to the respective lower surfaces 24 and 44 of said front 20 and rear 40 sections of the deck with resins or glues, leaving a region surrounding the interface 3 between said front section 20 and said rear section 40 where said layers of fibers are not directly bound to the deck and are able to separate from said lower surfaces 24 and 44 and bend. The portion of the flexible element that is not attached to said lower surfaces 24, 44 of said sections 20, 40 and bends when the longboard enters its folded configuration is shown in FIGS. 4-7 and FIG. 9 with the reference number 5. Said portion of flexible element 5 is straightened out when the longboard is in its elongated configuration and is in charge of keeping the two sections 20 and 40 of the deck together.

Figure 10:
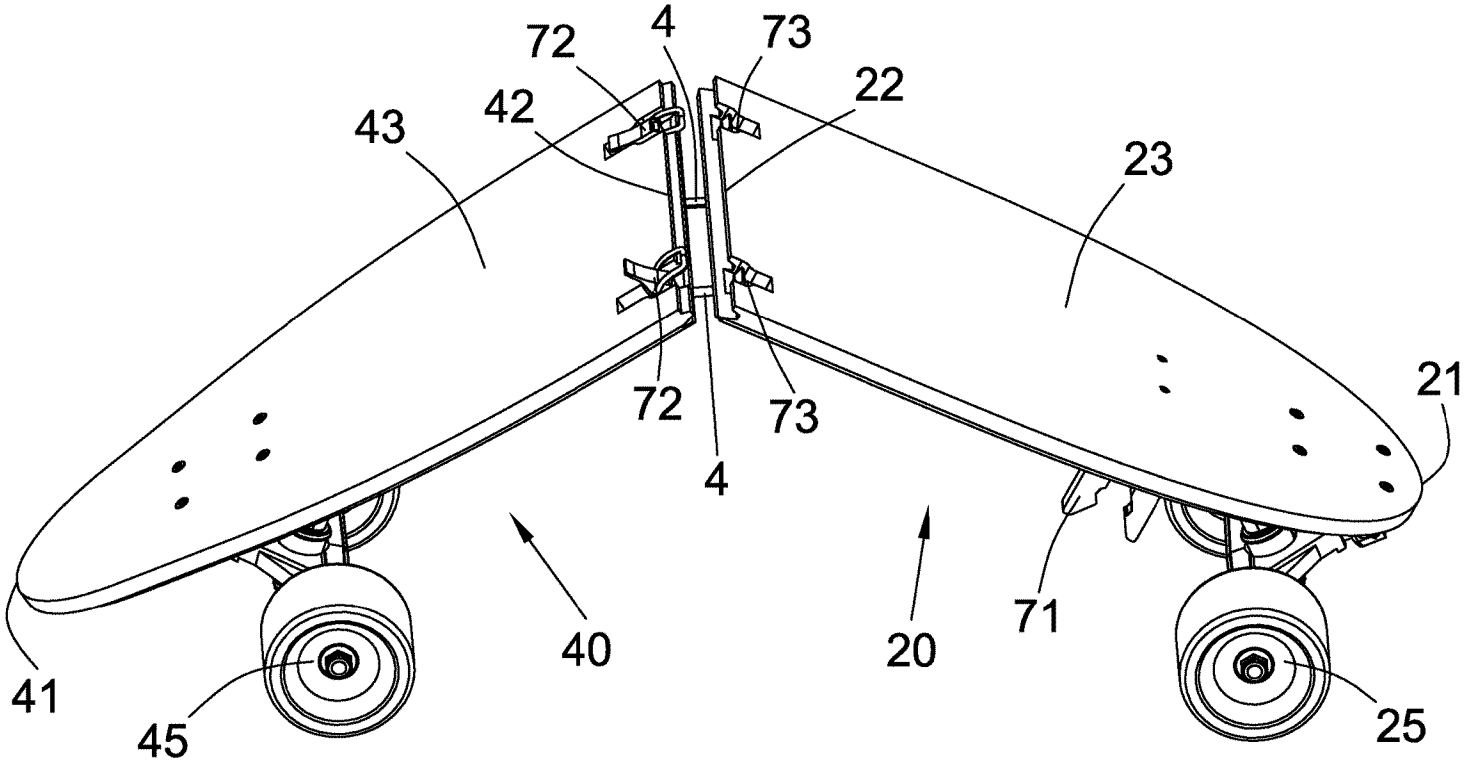
FIG. 10 is a top perspective view of the longboard set halfway between its elongated configuration and its folded configuration where the flexible element is implemented with two ropes and where additional mechanism for locking the longboard in its elongated and folded configurations are shown.
Figure 11:
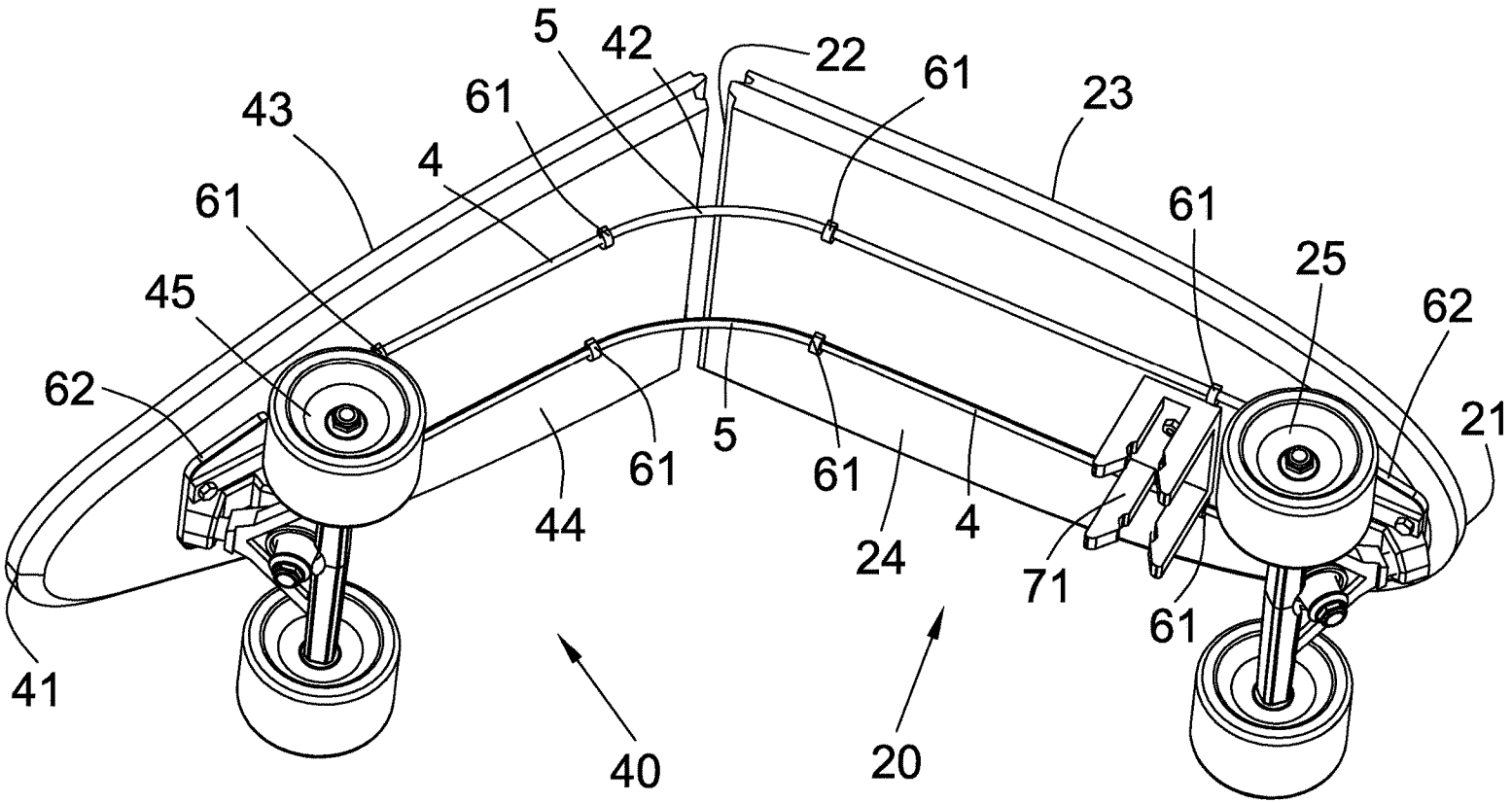
FIG. 11 is a bottom perspective view of the longboard set halfway between its elongated configuration and its folded configuration where the flexible element is implemented with two ropes and where an additional mechanism for locking the longboard in its folded configuration is shown.

A second possible embodiment of the invention, as illustrated in FIGS. 10-11, describe the use of multiple flexible elements 4 and some of the optional parts and assemblies that are later referenced in the appended claims. In this embodiment there are two flexible elements 4 implemented with two ropes attached to said lower surface 24 of said front section 20 and to said lower surface 44 of said rear section 40 with the use of specific fixtures 62 and additional cable holders 61. Said ropes will bend near the interface 3 between said front section 20 and said rear section 40, on section 5, when the longboard enters its folded configuration. Said ropes will be straight and will hold the two sections 20 and 40 of the deck together and in the appropriate position when the longboard is in its elongated configuration.

FIGS. 10-11 show an exemplificative implementation of a securing assembly 71 holding the longboard in its folded configuration when engaged. Said securing assembly is attached to the lower surface 24 of said front section 20 with screws or nuts and bolts and works by interlocking, being slightly flexible, with the rear wheel assembly 45 and holding it in a fixed position relative to said front section 20. This embodiment is to be considered, like all the others introduced in these chapters, a simple example of the concept better defined by the appended claims as much better ways of implementing such function exist.

To avoid the longboard from exiting its elongated configuration whenever the rider steps outside the area of the deck between the front wheel assembly 25 and the rear wheel assembly 45, one or more securing assemblies can be implemented for holding the longboard in its elongated configuration when engaged. FIG. 10 shows an exemplificative implementation of said securing assemblies where two latches composed of two parts each, one 73 bound to said front section 20 and one 72 bound to said rear section 40, exhibit, when engaged, some tensile resistance near the upper surfaces 23 and 43 of said deck sections 20 and 40 in the direction going from said rear end 41 to said front end 21 of the deck. Said tensile resistance avoids the deck parts to separate and, therefore, the longboard to exit the elongated configuration. The ultimate tensile strength of the engaged latches can be much lower than that of the flexible element 4 as the forces pulling the longboard out of its elongated configuration are much weaker during normal use than those trying to further bend the elongated longboard in the unfolding direction.

Figure 6:
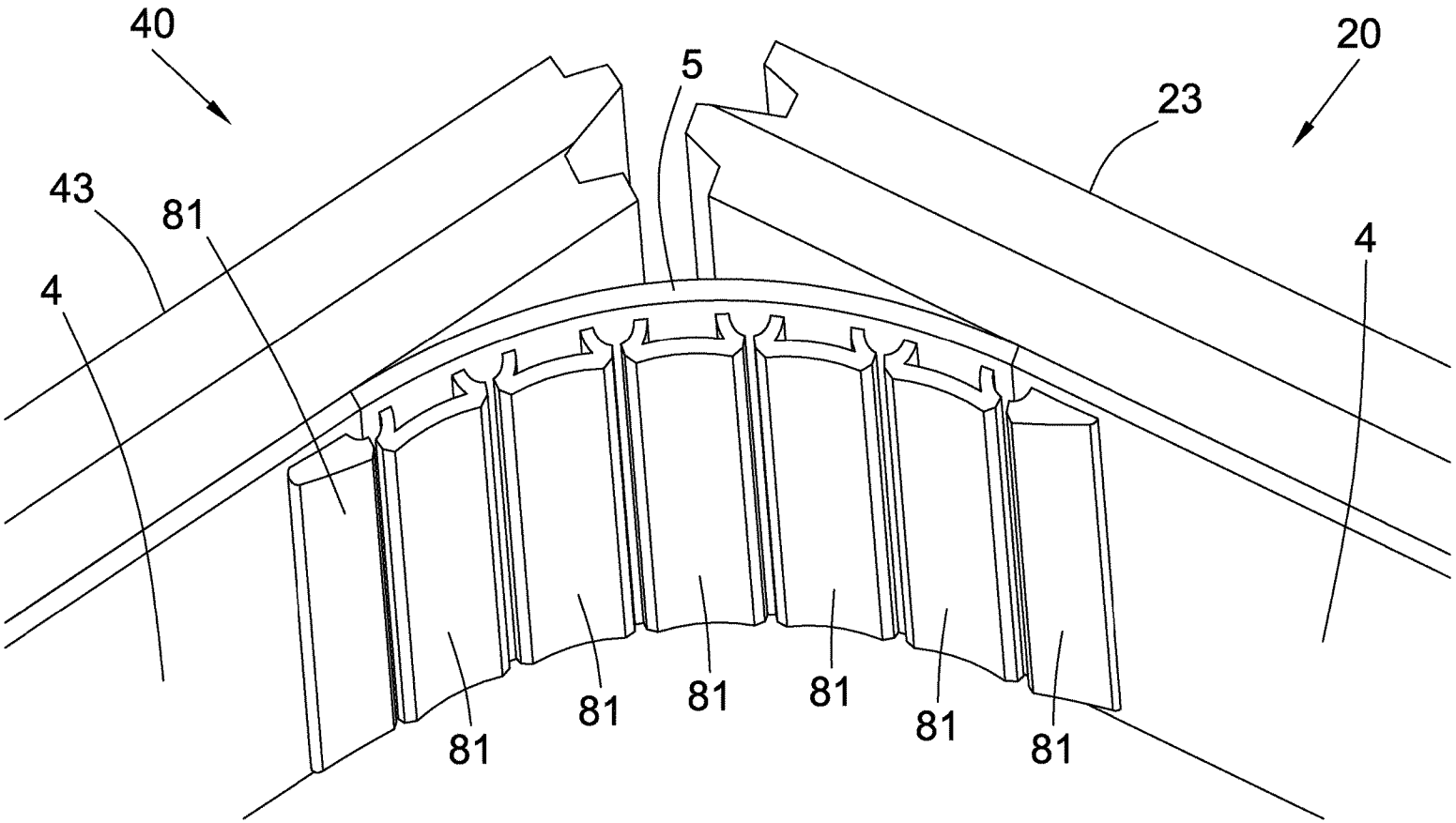
FIG. 6 is a detailed bottom perspective view of the longboard set halfway between its elongated configuration and its folded configuration where the flexible element is implemented with layers of industrial fibers and where an additional mechanism for limiting the maximum angle at which the flexible element is locally bent can be seen.
Figure 7:
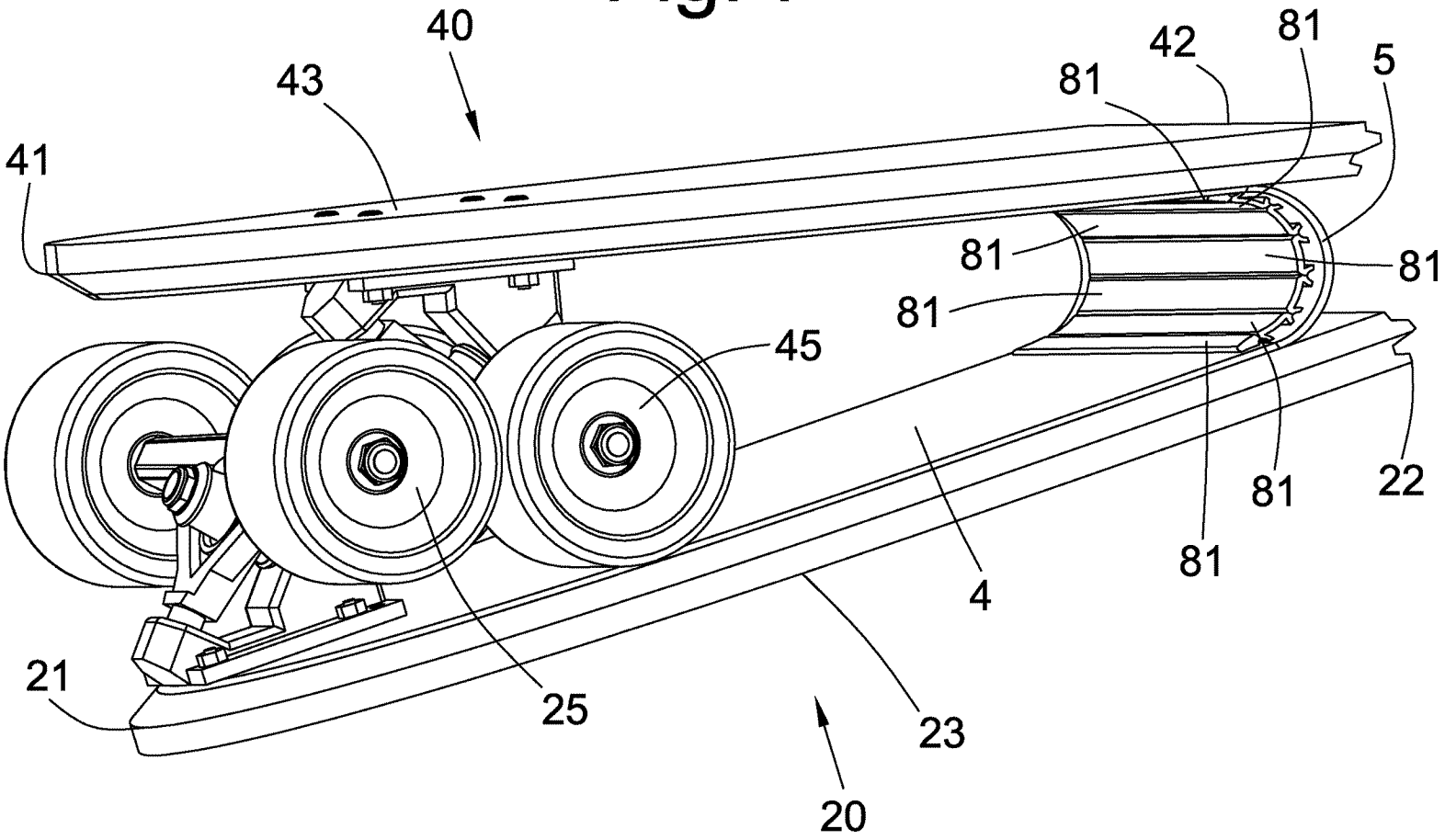
FIG. 7 is a top perspective view of the longboard set in its folded configuration where the flexible element is implemented with layers of industrial fibers and where an additional mechanism for limiting the maximum angle at which the flexible element is locally bent can be seen.

A further additional part that the system might include is a structure to avoid the flexible element 4 to bend too tight preventing it to wear prematurely. An exemplificative embodiment of said structure is shown in FIGS. 6-7 on a longboard implementing said flexible element 4 with a panel composed of one or more layers of glass fibers or synthetic fibers as described previously. Such system consist of a series of separated specifically shaped bars 81 each of them bonded to the lower surface of the panel implementing the flexible element 4. Said bars 81 are normally separated by a gap when the longboard is out of its folded configuration, as can be seen in FIG. 6, and come in contact with each other when the flexible element 4 is bent to the desired maximum angle when the longboard is in its folded configuration, as can be seen in FIG. 7. In this configuration the bars 81 are touching each other and prevent the flexible element 4 to bend further. While this mechanism don't ensure that the flexible element 4 will bent homogeneously, it is effective to ensure that said flexible element 4 won't bent too tight at any given point.

Figure 8:
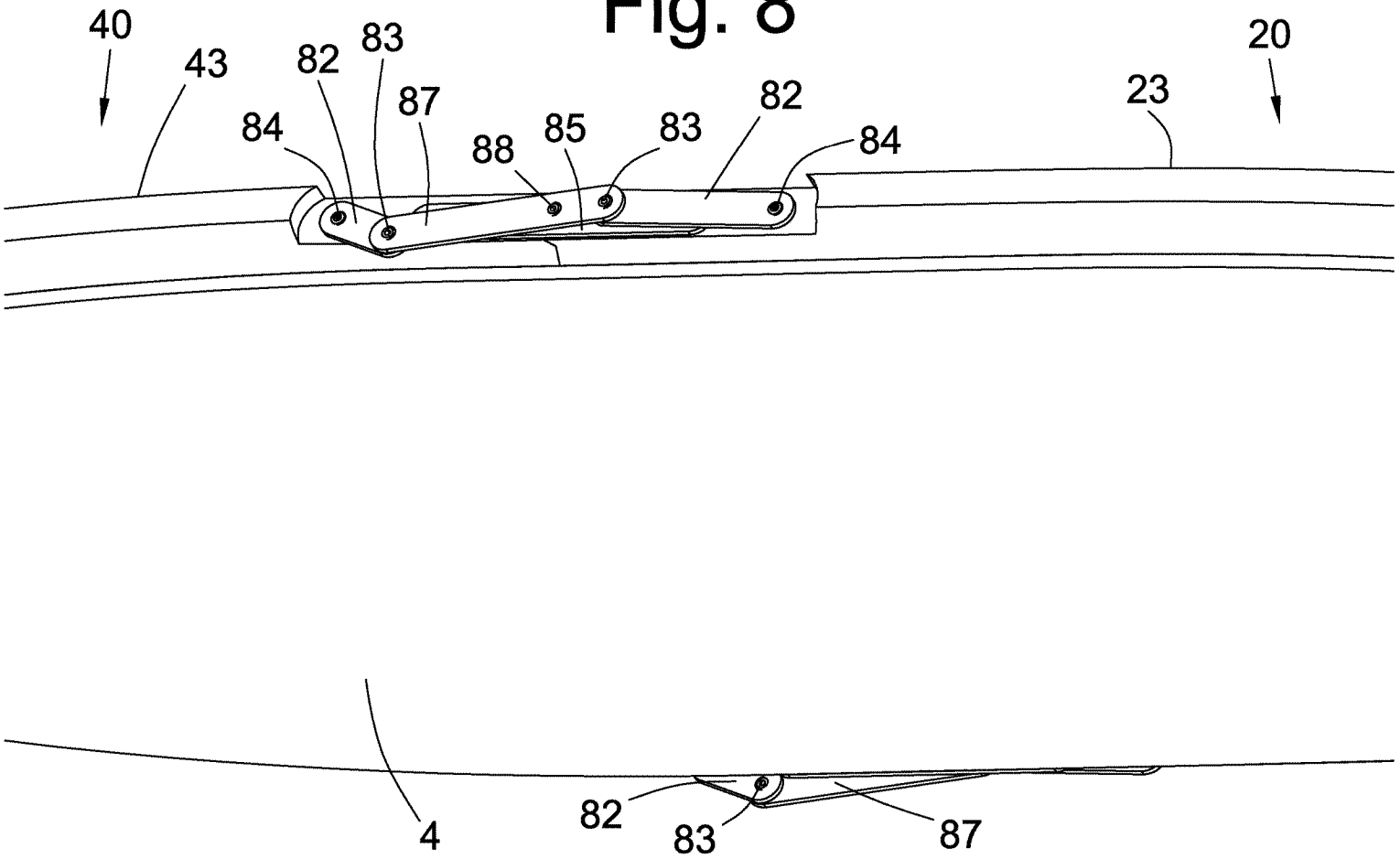
FIG. 8 is a detailed bottom perspective view of the longboard set in its elongated configuration where the flexible element is implemented with layers of industrial fibers and where an additional mechanism for better controlling the folding/unfolding movement can be seen.
Figure 9:
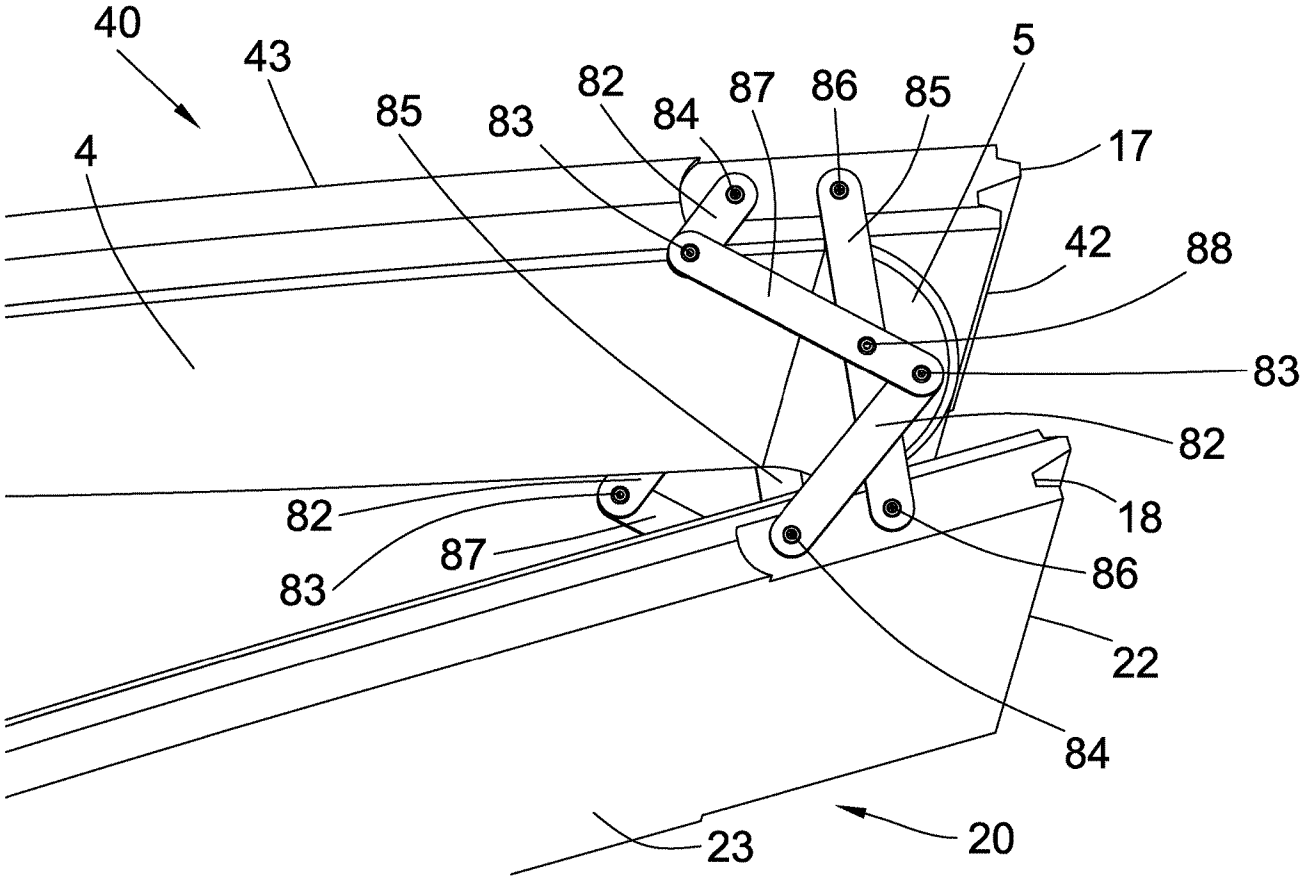
FIG. 9 is a detailed bottom perspective view of the longboard set in its folded configuration where the flexible element is implemented with layers of industrial fibers and where an additional mechanism for better controlling the folding/unfolding movement can be seen.

Another optional component that can be implemented on the folding longboard is a mechanism for precisely controlling the movement of the different deck sections 20 and 40 when switching between folded and elongated configuration. In FIGS. 8-9 a particular embodiment can be seen where said mechanism consist of two mirrored assemblies mounted on both sides of the deck across the front section 20 and the rear section 40. Each assembly consist of a main lever 85 with each extremity attached to a different section 20 and 40 of the deck with screws 86, said screws acting also as pivot points between said main lever 85 and the associated deck sections 20 and 40. An additional lever 87 is attached to the center of said main lever 85 with a pivot 88. Each extremity of said additional lever 87 is attached with pivots 83 to an extremity of two other levers 82 each of which is attached on the other extremity to a different deck section 20 and 40 with screws 84 acting as pivot points between the deck sections 20, 40 and said levers 82. Such construction forces the deck sections 20 and 40 to follow a specific route when switching between folded configuration and elongated configuration avoiding undesired movements along different directions. This assembly also helps in reducing the additional stress subjecting the flexible element 4 when the longboard is in its folded configuration and external forces are applied to the different deck sections 20 and 40 from unexpected directions.

While the invention has been particularly shown and described with reference to preferred embodiments thereof, it will be understood by those skilled in the art that changes in form and detail may be made therein without departing from the spirit and scope of the invention.

What is claimed is:

1. A folding longboard comprising:

a front section having a front end, a rear joint margin, an upper surface, a lower surface and a front wheel assembly near said front end;

a rear section having a front joint margin, a rear end, an upper surface, a lower surface and a rear wheel assembly near said rear end;

a folding assembly composed of at least one indivisible flexible element substantially non stretchable along its length and spanning both said front and rear sections;

the folding assembly being firmly attached, directly or indirectly, to said lower surfaces of said front and rear sections while being able to bend in an area surrounding a boundary between said front section and said rear section, wherein the flexible element is configured to allow said front and rear sections to be placed into a folded position towards said respective lower surfaces when said folding longboard is in a folded configuration, and wherein the flexible element is configured to inhibit rotation of said front and rear sections in a direction of said upper surfaces when said folding longboard is in an elongated configuration, wherein, in the elongated configuration, said upper surfaces of said front and rear sections are mutually substantially coplanar and form a contiguous longboard deck;

wherein the folding longboard further comprises means for limiting the maximum angle to which said indivisible flexible element bends locally at any given point.

2. The folding longboard as disclosed in claim 1 wherein one or more of said at least one indivisible flexible element are composed of one or more layers of glass fibers or synthetic fibers chosen among carbon fiber, aramid fibers or a mix of these materials, said one or more layers of fibers being bound together.

3. The folding longboard as disclosed in claim 2 wherein said one or more layers of fibers are firmly attached to the lower surface of said front section and said rear section with resins or glues, wherein a region surrounding the boundary between said front section and said rear section is left without the resins or glues, thus configuring said layers of fibers to separate from said lower surfaces and bend at the region.

4. The folding longboard as disclosed in claim 1 further comprising one or more tongue and groove joints implemented on said rear joint margin of said front section and said front joint margin of said rear section, the one or more tongue and groove joints interlocking together when said folding longboard is in elongated configuration.

5. The folding longboard as disclosed in claim 1 further comprising an additional mechanical system implemented with the purpose of controlling the movement of said front and rear sections when switching between elongated and folded configurations and avoiding each section of said folding longboard to move along inopportune directions when in folded configuration.

6. The folding longboard as disclosed in claim 1 further comprising one or more securing assemblies able to fasten said front section to said rear section when said folding longboard is in its folded configuration, the one or more securing assemblies impeding movements of said front section and said rear section against each other, and maintaining said folding longboard in its folded configuration until said securing assemblies are disengaged.

7. The folding longboard as disclosed in claim 1 further comprising one or more securing assemblies able to fasten said front section to said rear section when said folding longboard is in the elongated configuration, the one or more securing assemblies impeding said folding longboard from exiting the elongated configuration until said securing assemblies are disengaged.

* * * * *